United States Patent [19]

Campbell

[11] 4,387,577

[45] Jun. 14, 1983

[54] BOILERS

[75] Inventor: John W. E. Campbell, Maidenhead, England

[73] Assignee: Babcock Power Limited, London, England

[21] Appl. No.: 177,907

[22] Filed: Aug. 14, 1980

[30] Foreign Application Priority Data

Aug. 16, 1979 [GB] United Kingdom ..... 7928666

[51] Int. Cl.[3] ..... F01K 7/22

[52] U.S. Cl. ..... 60/680; 60/657; 60/677

[58] Field of Search ..... 60/646, 653, 657, 678, 60/679, 680; 376/316

[56] References Cited

U.S. PATENT DOCUMENTS

| | | | |
|---|---|---|---|
| 3,930,371 | 1/1976 | Schabert | 60/680 X |
| 3,979,914 | 9/1976 | Weber | 60/653 X |
| 4,187,146 | 2/1980 | Shen et al. | 60/657 X |

*Primary Examiner*—Allen M. Ostrager
*Assistant Examiner*—Stephen F. Husar
*Attorney, Agent, or Firm*—Kemon & Estabrook

[57] ABSTRACT

A power plant forced-flow boiler operative with water letdown wherein the letdown water is arranged to deliver heat to partly expanded steam passing through a steam reheater connected between two stages of a prime mover. The heating of steam in the reheater by letdown water will partly or wholly replace the use of live steam for such purpose so that the live steam will be available for driving the prime mover.

12 Claims, 1 Drawing Figure

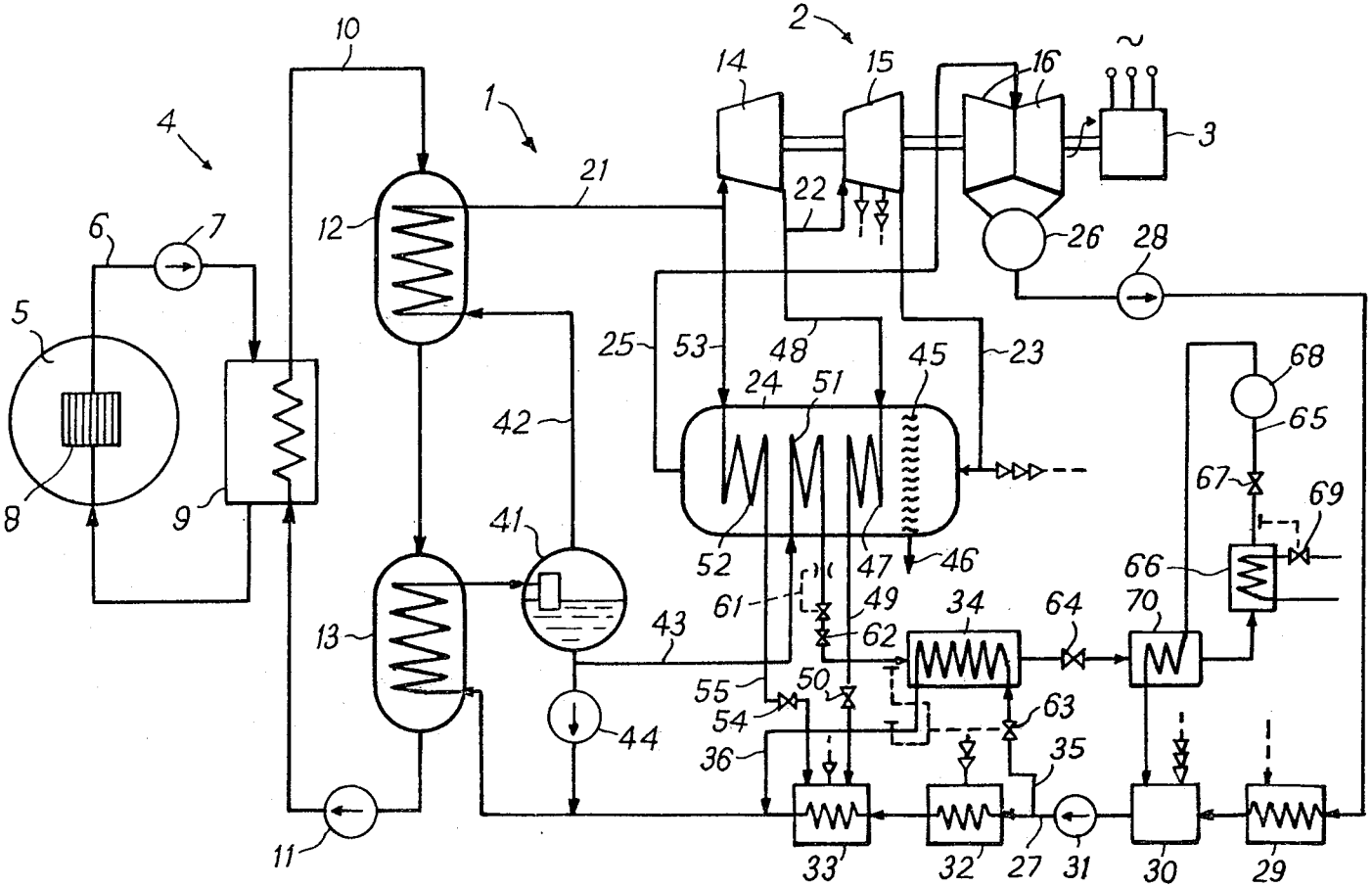
1
2
3
4
5
6
7
8
9
10
11
12
13
14
15
16
21
22
23
24
25
26
27
28
29
30
31
32
33
34
35
36
41
42
43
44
45
46
47
48
49
50
51
52
53
54
55
61
62
63
64
65
66
67
68
69
70

BOILERS

DESCRIPTION

This invention relates to power plant forced-flow boilers operative with water letdown.

It is sometimes desirable that power plant forced-flow boilers with the forced flow of the working fluid through steam generating tubes should be designed with a steam—and water—separating vessel or drum and arranged for a continuous withdrawal or letdown at normal load of some or all of the separated water from the drum and its passage through demineralizing means for the removal or reduction of solids and solid solutes therefrom. It is known to recover much of the heat in the letdown water leaving the drum by passing the letdown water through a heat exchanger cooled by boiler feedwater on its way from the condenser to the boiler economizer.

The present inventor observes that the mentioned manner of recovering letdown water heat involves a degradation of heat without the gain of a corresponding conservation of latent heat in the overall cycle such as is achieved by feed heating that exploits the condensation of partly expanded steam bled for the purpose from one or more stages of the prime mover, such as turbines, driven by the steam.

According to the present invention, in a power plant forced-flow boiler operative with water letdown the letdown water is arranged to deliver heat to partly expanded steam passing through a steam reheater connected between two stages of the prime mover.

Although in many power plants reheaters are heated by the heating fluid that effects in the boiler the necessary water heating, steam generating and steam superheating, in other power plants, including some reactor power plants, it may be necessary, or desirable for various reasons, to employ other fluids for reheating purposes. For example, some of the heating fluid for a reheater may be a flow of steam withdrawn from the live steam main from the superheater and passed into a tube bank of the reheater and another part of the heating fluid for such a reheater may be a flow of steam withdrawn from the prime mover at a stage earlier than the stage at which there is withdrawn the steam that is to be reheated and passed into another tube bank of the reheater, the steam flows delivering up heat in the respective tube banks while cooling and condensing therein. The present invention may supplement or partly or wholly replace the heating of such a reheater by such steam flows; if, as is envisaged, the heating of steam in the reheater by letdown water partly or wholly replaces the use of live steam for the purpose then more or all of the live steam will be available for its more proper function of driving the prime mover.

The letdown water leaving the reheater will in general contain enough heat to warrant its being further cooled by boiler feedwater.

The letdown water is cooled in the reheater, but such precipitation of solid solutes as there may be in the for example tubes carrying the letdown water in the reheater ought reasonably to be less than in the final boiling zone of the boiler steam generating tubes and will certainly be less per unit area than it would be in a feedwater heater arranged for cooling letdown water passing directly from the drum thereto.

The invention will now be described by way of example with reference to the accompanying drawing representing diagrammatically the major elements of a nuclear reactor power plant.

With reference to the drawings, a thermal power plant forcedflow boiler 1 is arranged for driving prime motive means 2, themselves driving an electric generator 3, from the heat energy which it absorbs from a heating source 4. The heating source 4 is shown as a primary heat source in the form of a nuclear fast reactor 5, a primary coolant circuit 6 arranged for driving liquid sodium under the propulsion of a pump 7 through the core 8 of the reactor to cool the said core and then through an indirect contact heat exchanger 9 to cool the liquid sodium of the circuit and a secondary coolant circuit 10 arranged for driving liquid sodium under the propulsion of a pump 11 through the heat exchanger 9 to absorb heat from the liquid sodium of the primary coolant circuit 6 and then through indirect contact heat exchangers 12 and 13 adapted for heating water and generating and superheating steam in the boiler 1 from the heat in the liquid sodium of the secondary coolant circuit.

The heat exchanger 12 is constructed as a pressure vessel with a flow path in the interior thereof for the liquid sodium of the secondary coolant circuit, and in such flow path heat exchange surface, shown conventionally in the drawing, is arranged in the form of parallel-connected tubes serving as steam superheating tubes of the boiler. The heat exchanger 13 is also constructed as a pressure vessel with a flow path in the interior thereof in which heat exchange surface, shown conventionally in the drawing, is arranged in the form of parallel-connected tubes serving as water heating and steam generating tubes of the boiler.

The prime motive means comprise high pressure, intermediate pressure and a pair of low pressure steam turbines 14, 15 and 16 respectively. A live steam main 21 is arranged for leaving superheated steam from the superheater tubes of the heat exchanger 12 to the inlet of the high pressure turbine 14, a steam conduit 22 for leading steam from the outlet of the turbine 14 to the inlet of the intermediate pressure turbine 15, a steam conduit 23 for leading steam from the outlet of the turbine 15 to a reheater 24 and a steam conduit 25 for leading steam from the reheater 24 to the inlet of the low pressure turbines 16. The steam expands progressively in driving the turbines and on leaving the turbines 16 is at a very low pressure at which it is arranged to be liquefied in a condenser 26. The resulting condensate is arranged to be fed to the water, heating and steam generating tubes of the heat exchanger 13 through a water line 27 in which are placed an extraction pump 28, a closed feedwater heater 29, a de-aerating feedwater heater 30, a boiler feedwater pump 31, a closed feedwater heater 32 and a closed feedwater heater 33. A path is provided for leading some of the feedwater to by-pass the heaters 32 and 33 and to be heated instead in a letdown water cooler 34, the shunt path including an inlet feedwater line 35 to and an outlet feedwater line 36 from the cooler 34. The feedwater heaters 29, 30, 32 and 33 are regenerative feedwater heaters, the heater 33 being arranged, as indicated by the stub lines with single white arrowheads, to receive a steam flow bled from a stage of the intermediate pressure turbine 15, the heater 32 being arranged, as indicated by the stub lines with double white arrowheads, to receive a steam flow bled from a lower pressure stage of the intermediate pressure turbine 14, the heater 30 being arranged, as indicated by the stub lines with treble white arrowheads, to receive a steam flow bled from the steam conduit 23 and the heater 29 being arranged to receive a steam flow bled from stages of the low pressure turbines 16. Not shown are connections to lead condensate from the heater 33 into the heater 32, to lead condensate from the heater 32 into the heater 30 and to lead condensate from the heater 29 into the condenser 26.

The boiler includes a steam and water separating drum 41 which is arranged to receive the discharges, which contain steam, from the steam generating tubes of the heat exchanger. A steam conduit 42 is arranged for forwarding to the steam superheating tubes of the heat exchanger 12 steam separated from water in the drum 41, a letdown water line 43 is provided for the continuous removal of water separated from steam in the drum 41, and a recirculation pump 44 is provided to make possible, should occasion demand it, a withdrawal of water from the drum 41 and its re-injection into the feedwater line 27 prior to the water heating tubes of the heat exchanger 13.

The reheater 24 may be constructed as an elongate pressure vessel providing for the steam to be reheated a path for flow generally from one end to the other of the vessel. In the flow path for the steam to be reheated there is firstly positioned a water or moisture separator 45 adapted for the removal of water droplets from the steam flow, the reheater having a drain withdrawal 46 for the resulting water, then a tube bank 47 arranged for receiving from a conduit 48 a steam flow bled from the steam conduit 22 and arranged for passing the flow as condensate by way of a line 49, in which a control valve 50 is positioned, to the feedwater heater 33. The steam to be reheated then flows over a second tube bank 51 arranged to be traversed by the letdown water of the conduit 43. A third tube bank 52 may also be arranged within the reheater for transfer of further heat to the steam to be reheated, such tube bank being arranged to receive from a conduit 53 a steam flow from the live steam main 21 which is under the control of a control valve 54 in a line 55 for leading the flow as condensate from the tube bank 52 to the feedwater heater 33.

The letdown water after it has traversed the tube bank 51 in the reheater 24 passes through a flow controller 61 comprising a control valve under the influence of a flow sensor, then through a pressure reducer 62 and enters the previously-mentioned letdown water cooler 34. In the cooler 34 preferably, as indicated, the flows of the two fluids are in general counterflow in relation to one another. The flow of feedwater to the cooler 34 for cooling the letdown water and by-passing the feedwater heaters 32 and 33 is under the control of a valve 63 in the feedwater inlet line 35 influenced both by the temperature of the letdown water entering the cooler 34 and by the temperature of the feedwater in the feedwater return line 36 in such a way that the latter temperature is maintained with a predetermined temperature difference below the former temperature.

The letdown water from the cooler 34 passes through a second pressure reducer 64 and then through a letdown water loop 65 which includes a second letdown water cooler 66, a third pressure reducer 67 and demineralizing means 68 of known kind for the removal of particles and solid solutes from the water, from which loop the letdown water is discharged into the de-aerating feedwater heater 30 in which it joins the feedwater flow in the line 27. The cooling fluid for the second letdown water cooler 66 is controlled in flow rate by a control valve 69 influenced by the temperature of the letdown water leaving the cooler 66 in such a manner as to maintain said temperature at a constant value and one suitable for good demineralizer operation.

At the entry to the letdown water loop 65 is a heat exchanger 70 arranged for the transfer of heat from the letdown water entering the loop to the letdown water leaving the loop. The letdown water cooled in the said heat exchanger 70 passes in succession through the second letdown water cooler 66, the third pressure reducer 67 and the demineralizing means 68 before it returns to the said heat exchanger 70 to pick up heat therein.

In the operation of the power plant, the boiler pump 30 delivers feedwater at an appropriate pressure and an appropriate rate for the boiler 1, with an appropriate water level in the drum 41, to perform its function in the conversion of heat generated in the reactor core 8 to power delivered by the electric generator 3. At normal load and over an upper load range generally the recirculation pump 44 is not operated and the water which separates in the separating drum 41 from the discharges into the said drum from the said water heating and separating tubes of the heat exchanger 13 is withdrawn from the drum through the line 43. The letdown water flow rate may typically be of the order of 10% of the water flow rate delivered by the pump 30 at normal load on the boiler.

The letdown water passes through the tubes of the tube banks 51 and supplies heat to steam which has been partly expanded and cooled in driving the high pressure and intermediate turbines 14 and 15 and which passes through the reheater 24 before being finally expanded and cooled in driving the low pressure turbines 16. The heat which the letdown water so loses by passing into steam to be reheated is degraded less than it would be degraded by being caused to pass into feedwater to be heated.

In view of the reheating duty performed by the tube bank 51, the necessity to provide in the flow of steam to be reheated a third tube bank (the bank 52) to receive live steam is reduced and, if such a third tube bank is provided, it may be designed for only a small duty. The loss of efficiency due to using live steam for steam reheating rather than for driving the prime motive means may therefore be avoided or reduced.

Since the device 61 is arranged in the letdown water flow after the letdown water has been cooled in the reheater 24 the flow sensor element of the device 61 operates on water well below saturation temperature and therefore more accurately than it would act on water still capable of carrying steam bubbles.

The letdown water is then further cooled in the letdown water cooler 34 in supplying heat by indirect contact to feedwater in a feedwater flow path in shunt to the regenerative feedwater heaters 32 and 33. An advantage of cooling the letdown water in the cooler 34 which is not a bled steam fed regenerative feedwater heater is that the heat exchange surfaces have "solid" water on both sides, moreover there is no dilution of the letdown water with bled steam condensate before it enters the demineralizing means 68, whereas if the letdown water were led for cooling into the regenerative feedwater heater 33, for example, before proceeding to the demineralizing means, the heat exchange surfaces therein would act inefficiently by reason of the flashing of letdown water into steam in the heater 33 and moreover the bled steam condensate would add to the bulk of the letdown water proceeding to the means 68.

The pressure reducers 62, 64 and 67 in the letdown water flow path progressively diminish the letdown water pressure and allow the tubes and vessels containing letdown water to be designed for successively lower pressure requirements.

I claim:

1. A forced-flow boiler for a power plant that comprises a main circuit for steam/water working fluid which includes boiler feedwater heating means, boiler steam generating means, a steam-driven prime mover stage, boiler steam reheating means, a lower-pressure steam-driven prime mover stage, a boiler steam condenser and pumping means for driving the working fluid around the circuit, the boiler including a boiler water letdown sub-circuit including means for continuously separating unevaporated water from the boiler working fluid leaving the boiler steam generating means, means for continuously treating the letdown water and means for allowing the treated letdown water continuously to join feedwater in the main circuit, wherein the said boiler steam reheating means includes a heat exchanger arranged for continuously transferring heat from the letdown water to the steam to be reheated.

2. A boiler as claimed in claim 1, wherein the reheater is arranged for a flow of the steam to be reheated over a tube bank which is arranged to be supplied with a flow of steam of higher temperature than the steam to be reheated and withdrawn from a stage of the prime mover, and which is arranged to discharge to a regenerative feedwater heater of the boiler, and for a flow of the steam to be reheated then over a tube bank through which the said letdown water is arranged to pass.

3. A boiler as claimed in claim 2, wherein a flow controller for the letdown water comprising a control valve under the influence of a flow sensor is provided in the letdown water path at a point next subsequent to the tube bank in the reheater through which the feedwater passes.

4. A boiler as claimed in claim 3, wherein a pressure reducer is provided in the letdown water path at a point next subsequent to the flow controller.

5. A boiler as claimed in claim 1 wherein the letdown water is arranged, after it has delivered heat to partly expanded steam in the reheater, to pass through a letdown water cooler cooled by boiler feedwater.

6. A boiler as claimed in claim 5, wherein the boiler feedwater for cooling the said letdown water cooler flows in a shunt path which bypasses regenerative feedwater heating means.

7. A boiler as claimed in claim 6, wherein for the flow of feedwater in the said shunt path a control valve is provided which is influenced both by the temperature of the letdown water entering the letdown water cooler and the temperature of the feedwater leaving the said letdown water cooler.

8. A boiler as claimed in claims 5 or 7, wherein the letdown water cooler is arranged for general counterflow of the letdown water and feedwater in relation to one another.

9. A boiler as claimed in claim 5 wherein a pressure reducer is provided in the letdown water path at a point next subsequent to the said letdown water cooler.

10. A boiler as claimed in claim 5 wherein the letdown water, after it has been cooled in the said letdown water cooler, passes through a letdown water loop which includes a further letdown water cooler and demineralizing means adapted for the removal of particles and solid solutes from the water, at the entry to which loop is a heat exchanger arranged for the transfer of heat from the letdown water entering the loop to the letdown water leaving the loop.

11. A boiler as claimed in claim 10, wherein a pressure reducer is provided in the letdown water loop at a point next subsequent to the said further letdown water cooler.

12. A boiler as claimed in claim 10 or claim 11, wherein the letdown water, after it has passed the letdown water loop, is arranged to discharge into the boiler feedwater flow at a feedwater heater prior to the boiler feedwater pump.

* * * * *